US006820547B2

(12) United States Patent
Fujiwara

(10) Patent No.: US 6,820,547 B2
(45) Date of Patent: Nov. 23, 2004

(54) SUPPORT STRUCTURE FOR A BLANKET CYLINDER OF AN OFFSET PRINTING PRESS

(75) Inventor: Shigeo Fujiwara, Fuchu (JP)

(73) Assignee: Ryobi, Ltd., Hiroshima (JP)

( * ) Notice: Subject to any disclaimer, the term of this patent is extended or adjusted under 35 U.S.C. 154(b) by 0 days.

(21) Appl. No.: 10/695,279

(22) Filed: Oct. 28, 2003

(65) Prior Publication Data

US 2004/0083911 A1 May 6, 2004

(30) Foreign Application Priority Data

Oct. 31, 2002 (JP) ..... 2002-317865

(51) Int. Cl.[7] ..... B41F 13/24; B41F 7/02; B41F 5/22; B41F 13/20; B41F 13/28

(52) U.S. Cl. ..... 101/218; 101/217; 101/137; 101/247; 101/116

(58) Field of Search ..... 101/217–218, 101/137–145, 116, 247, 115

(56) References Cited

U.S. PATENT DOCUMENTS 4,041,864 A * 8/1977 Dahlgren et al. ..... 101/350.4
4,458,591 A * 7/1984 Guaraldi ..... 101/247
5,094,162 A * 3/1992 Tafel et al. ..... 101/137
5,167,187 A * 12/1992 Dettinger et al. ..... 101/218
5,272,975 A * 12/1993 Dettinger et al. ..... 101/218
5,488,902 A * 2/1996 Dorenkamp ..... 101/216
5,740,736 A * 4/1998 Toyoda ..... 101/218
5,937,755 A * 8/1999 Preuss et al. ..... 101/218

* cited by examiner

*Primary Examiner*—Daniel J. Colilla
*Assistant Examiner*—Marissa Ferguson
(74) *Attorney, Agent, or Firm*—Perkins Coie LLP

(57) ABSTRACT

A support structure for a blanket cylinder of an offset printing press includes: a first eccentric bearing that is rotatably supported by frames of the offset printing press; a second eccentric bearing that is rotatably supported by the first eccentric bearing so as to rotatably support an shaft of a blanket cylinder; a printing pressure adjustment device that rotates the first eccentric bearing relative to the frames, thereby adjusting a clearance between an impression cylinder and a blanket cylinder; and a throw-on device that rotates the second eccentric bearing relative to the first eccentric bearing, thereby performing throw-on and throw-out operations. In the thus arranged support structure, a throw-on distance of the throw-on device is variable.

5 Claims, 13 Drawing Sheets

SUPPORT STRUCTURE FOR A BLANKET CYLINDER OF AN OFFSET PRINTING PRESS

CROSS REFERENCE TO RELATED APPLICATION

This application claims priority from Japanese Patent Application No. 2002-317865, which is incorporated herein by reference.

BACKGROUND OF THE INVENTION

1. Field of the Invention

The present invention relates to a support structure for a blanket cylinder of an offset printing press designed particularly taking into account the relationship between throw-on and throw-off operations of the blanket cylinder and printing pressure applied to an impression cylinder of the blanket cylinder.

2. Related Art

In the offset printing press, a blanket cylinder, also called as a rubber cylinder, is provided between a plate cylinder and an impression cylinder. This blanket cylinder has an axis movable so as to enable the blanket cylinder to be "thrown on", or drawn into engaging position, relative to the plate cylinder and the impression cylinder at the start of the printing operation, and "thrown out", or drawn out of the engaging position, relative to both cylinders at the end or interruption of the printing operation. In addition to the throw-on and throw-off operations, a printing pressure adjustment is performed every time the thickness of printing sheets such as sheets of paper (hereinafter referred to only "sheets") are to be changed in order to provide a printing pressure suitable for those sheets having a different thickness by adjusting the clearance between the blanket cylinder and the impression cylinder according to the thickness of the sheets, when the blanket cylinder has taken the throw-on position relative to the impression cylinder.

As a commonly applied arrangement in order to achieve the above throw-on/throw-out operations and the printing pressure adjustment as described such as in Japanese Unexamined Patent Publication (Kokai) Nos. HEI-04-226354, 2001-113669 and HEI-10-315429, the blanket cylinder is rotatably supported by double, outer and inner eccentric bearings mounted in the frame of the printing press. Specifically, the frame rotatably supports the outer eccentric bearing that in turn rotatably supports the inner eccentric bearing that in turn rotatably supports the blanket cylinder. Accordingly, by the rotation of the outer eccentric bearing, the blanket cylinder is moved via the inner eccentric bearing, thereby achieving the printing pressure adjustment. On the other hand, by the rotation of the inner eccentric bearing with the outer eccentric bearing locked in position, the blanket cylinder is moved, thereby achieving the throw-on/throw-out operations.

In the above support structure for the blanket cylinder, the adjustment of the clearance between the impression cylinder and the blanket cylinder on the basis of the thickness of printing sheets causes change in distance between the axes of the plate cylinder and the blanket cylinder (a center-to-center distance). If this change falls within an acceptable range, excessive load is unlikely to be applied to the plate cylinder or the blanket cylinder and therefore a printing trouble is not caused.

However, where the distance between the plate cylinder and the blanket cylinder becomes excessively smaller than an acceptable value due to an excessively large adjustment of the printing pressure such as for sheets having a thickness larger than a predetermined value, an excessive load is applied to the plate cylinder and the blanket cylinder, which may result in printing trouble. In order to avoid this trouble due to the small distance out of the acceptable range, an adjustment mechanism for moving the axis of the plate cylinder may be provided as proposed such as in Japanese Unexamined Patent Publication (Kokai) No. HEI-10-315429, but such mechanism complicates the structure of the printing press and hence increases the manufacturing cost.

The present invention has been conceived to address the above problems. It is an object of the present invention to provide a support structure for the blanket cylinder of the printing press that is capable of reducing the possibility to cause a printing trouble even in the printing operation for thicker sheets without the necessity to provide the adjustment mechanism enabling the movement of the axis of the plate cylinder.

SUMMARY OF THE INVENTION

According to the present invention, there is provided a support structure for a blanket cylinder of an offset printing press, which includes: a first eccentric bearing that is rotatably supported by frames of the offset printing press; a second eccentric bearing that is rotatably supported by the first eccentric bearing so as to rotatably support an shaft of a blanket cylinder; a printing pressure adjustment device that rotates the first eccentric bearing relative to the frames, thereby adjusting a clearance between an impression cylinder and a blanket cylinder; and a throw-on device that rotates the second eccentric bearing relative to the first eccentric bearing, thereby performing throw-on and throw-out operations. In the thus arranged support structure, a throw-on distance of the throw-on device is variable.

With the thus arranged support structure, the throw-on distance, that is, the change amount of the clearance between the blanket cylinder and the impression cylinder in the throw-on operation is variable so that, for example, when sheets are changed from thinner ones to thicker ones, the throw-on distance is set to be smaller, thereby enabling the printing pressure adjustment device to have a decreased adjusting amount corresponding to the decreased amount of the throw-on distance.

Preferably, the throw-on distance of the throw-on device is switchable between a standard throw-on distance and a thick-sheet throw-on distance (i.e., a throw-on distance for thick sheets). The thick-sheet throw-on distance is smaller than the standard throw-on distance. In the switching between such two alternatives, a switching mechanism in the throw-on device can be simplified so that the switching action can be securely and easily made whether or not it is manually or automatically made.

The support structure preferably further includes a control device that controls the printing pressure adjustment device and the throw-on device on the basis of the thickness of sheets to be printed. The control device switches the throw-on distance of the throw-on device from the standard throw-on distance to the thick-sheet throw-on distance and designates the result determined by subtracting the difference between the standard throw-on distance and the thick-sheet throw-on distance from the change amount of the thickness of sheets as the adjusting amount of the printing pressure adjustment device where the thickness of sheets before changing is less than a predetermined value and the thickness of sheets after changing is equal to or more than the predetermined value. Further, the control device switches the throw-on distance of the throw-on device from the thick-sheet throw-on distance to the standard throw-on distance and designates the result determined by subtracting the difference between the standard throw-on distance and the thick-sheet throw-on distance from the change amount of the thickness of sheets as the adjusting amount where the thickness of sheets before changing is equal to or more than the predetermined value and the thickness of sheets after changing is less than the predetermined value. Further, the control device does not switch the throw-on distance of the throw-on device and designates the change amount of the thickness of sheets as the adjusting amount of the printing pressure adjustment device where both the thicknesses of sheets before and after changing are either less than, or equal to or more than the predetermined value.

With the above arrangement, the switching operation is also automatized. As a result, the work load can be greatly reduced.

In the case where the support structure is designed for supporting plural blanket cylinders of a multi-color printing press, the printing pressure adjustment device and the throw-on device are provided for each of the plural blanket cylinders. In this arrangement, the control device makes the printing press incapable of printing where the throw-on distances of all the throw-on devices are not the same as each other. Thus, the control device can prevent occurrence of broke even if the throw-on distances of the respective blanket cylinders are not the same as each other.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

An embodiment of the support structure for a blanket cylinder according to one embodiment of the present invention will be herein described with reference to the drawings attached hereto.

Figure 1:
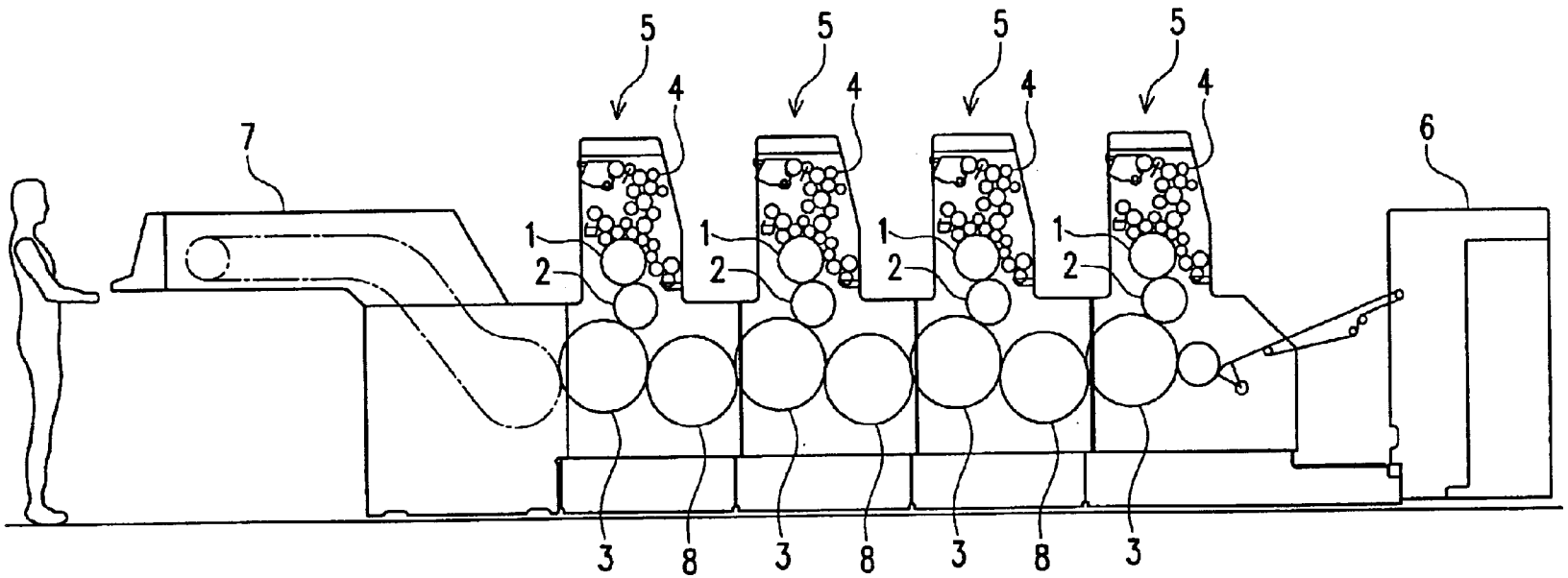
FIG. 1 is a schematic view of an offset printing press according to one embodiment of the present invention.

FIG. 1 illustrates an offset printing press that employs a blanket-cylinder support structure of the present invention. The printing press of the present invention is of a multi-color printing type. Specifically, the printing press has four printing units 5 in total aligned in tandem, each of which includes a plate cylinder 1, a blanket cylinder 2 (rubber cylinder), an impression cylinder 3 and an ink device 4. In the thus arranged printing press, sheets fed from a sheet feeding unit 6 are transferred through the printing units 5 and during the transfer, four colors each are printed on sheets at the corresponding printing unit 5, and then the printed sheets are transferred to a sheet discharge unit 7, through which the printed sheets are subsequently discharged. Transfer cylinders 8 each are disposed between the adjacent impression cylinders 3 so as to transfer sheets from the upstream impression cylinder 3 to the downstream impression cylinder 3. The number of the printing units 5, the cylinder arrangement and the like can be determined to be suitably adapted for each case.

The description will be hereinafter made for the support structure of one of the blanket cylinders 2. In this regard, it is to be noted that the same support structure is commonly used for all the blanket cylinders 2 of the printing units 5, and therefore the following description will be applicable to all of the support structures of the blanket cylinders 2.

Figure 2:
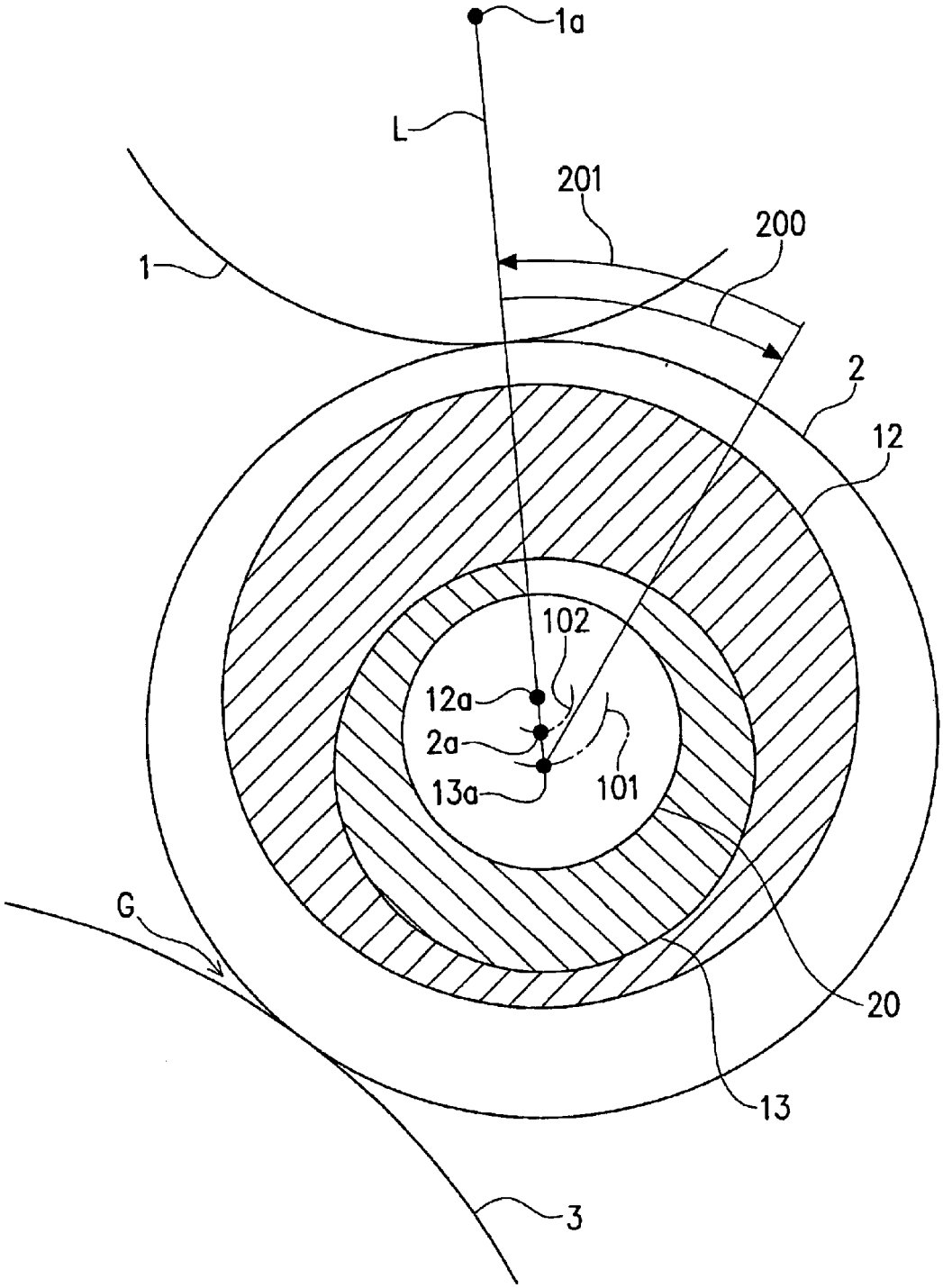
FIG. 2 is a schematic view of a support structure for a blanket cylinder according to one embodiment of the present invention.

As schematically illustrated in FIG. 2, the blanket cylinder 2 is rotatably supported by frames 10, 11 of the printing press (see FIGS. 3 and 4) via double bearings, namely first (outer) and second (inner) eccentric bearings 12, 13. Specifically, the frames 10, 11 together rotatably support the first eccentric bearing 12, which in turn rotatably supports the second eccentric bearing 13, which in turn rotatably supports a shaft 20 of the blanket cylinder 2. A specific arrangement of the first and second eccentric bearings is schematically illustrated in FIG. 2 and will be described hereinafter in detail.

An axis 12*a* of the first eccentric bearing 12 and an axis 13*a* of the second eccentric bearing 13 respectively represent the centers of the corresponding circumferences. The shaft 20 of the blanket cylinder 2 is located coaxial with the circumference of the blanket cylinder 2 and has an axis represented by a reference code 2*a*. As illustrated in FIG. 2, when a clearance G between the blanket cylinder 2 and the impression cylinder 3 is "0" (i.e., a basic position where the blanket cylinder 2 is held in contact with the impression cylinder 3), an axis 1*a* of the plate cylinder 1, the axis 2*a* of the blanket cylinder 2, and the axes 12*a*, 13*a* of the first and second eccentric bearings 12, 13 are all aligned along a straight line. More specifically, at the basic position, the axis 12*a* of the first eccentric bearing 12 divides internally a line L joining the axis 1*a* of the plate cylinder 1 and the axis 2*a* of the blanket cylinder 2, and the axis 13*a* of the second eccentric bearing 13 is located at a position where it divides externally the line L. This alignment arrangement is not essential in the present invention. It is possible to employ an alignment arrangement that the axis 1*a* of the plate cylinder 1, the axis 2*a* of the blanket cylinder 2, and the axes 12*a*, 13*a* of the first and second eccentric bearings 12, 13 are all aligned in a straight line, when the clearance G between the blanket cylinder 2 and the impression cylinder 3 is set to print on sheets having a thickness approximate to the center value of the sheet-thickness adjustment range.

As described above, the first (outer) eccentric bearing 12 is provided to adjust the clearance G between the blanket cylinder 2 and the impression cylinder 3 at the time of changing the sheet thickness. The rotation of the first eccentric bearing 12 relative to the frames 10, 11 causes the integral rotation of the second eccentric bearing 13 and the blanket cylinder 2 around the axis 12*a* of the first eccentric bearing 12 as respectively following arc trajectories 101, 102. It is necessary to move the blanket cylinder 2 away from the impression cylinder 3 for thicker sheets. This movement is accompanied by the movement of the axis 2*a* of the blanket cylinder 2 away from the axis of the impression cylinder 3 and closer to the axis 1*a* of the plate cylinder 1, as represented by the trajectory 102.

On the other hand, the second (inner) eccentric bearing 13 is provided to achieve the throw-on and throw-out operations by its reciprocal rotation within a constant angular distance relative to the first eccentric bearing 12, which reciprocal movement allows the blanket cylinder 2 to reciprocatingly travel between a throw-on position closer to the impression cylinder 3, which position enabling sheet clamping, and a throw-out position away from the impression cylinder 3. Specifically, as illustrated in FIG. 2, the axis 2*a* of the blanket cylinder 2 is moved around the axis 13*a* of the second eccentric bearing 13 as represented by an arrow 200 in the throw-on operation, and is moved in the opposite direction around the axis 13*a* of the second eccentric bearing 13 as represented by an arrow 201 in the throw-out operation.

Now, the description will be made for the specific construction of the first and second eccentric bearings 12, 13, as well as a printing pressure adjustment device 30 that rotates the first eccentric bearing 12 relative to the frames 10, 11 for adjustment of the clearance G between the blanket cylinder 2 and the impression cylinder 3, and a throw-on device 31 that rotates the second eccentric bearing 13 relative to the first eccentric bearing 12 for the throw-on and throw-out operations.

The first eccentric bearing 12 is made up of outer metal bearing part 32 having outer and inner circumferences, and a needle bearing part 33 located on the radially inner side of the bearing part 32. The outer metal bearing part 32 is rotatably supported in a through-hole of the frame 10 and has the axis of the inner circumference eccentric to the axis of the outer circumference. The needle bearing part 33 includes an outer ring and an inner ring, in which the outer ring is rotatable integrally with the outer metal bearing 32 and the inner ring is coaxial with the outer ring and rotatable relative thereto. The second eccentric bearing 13 is made up of an inner metal bearing part 34 having outer and inner circumferences, and a roller bearing part 35 that includes outer and inner rings and is located on the radially inner side of the inner metal bearing part 34. The inner metal bearing part 34 is rotatable integrally with the inner ring of the needle bearing part 33 and the axis of the inner circumference is eccentric to the axis of the outer circumference. The outer ring of the roller bearing part 35 is rotatable integrally with the inner metal bearing part 34, and the inner ring, which is rotatable relative to the outer ring, is coaxial with the same. The shaft 20 of the blanket cylinder 2 is inserted into the inner ring of the roller bearing part 35 for the integral rotation therewith.

Figure 3:
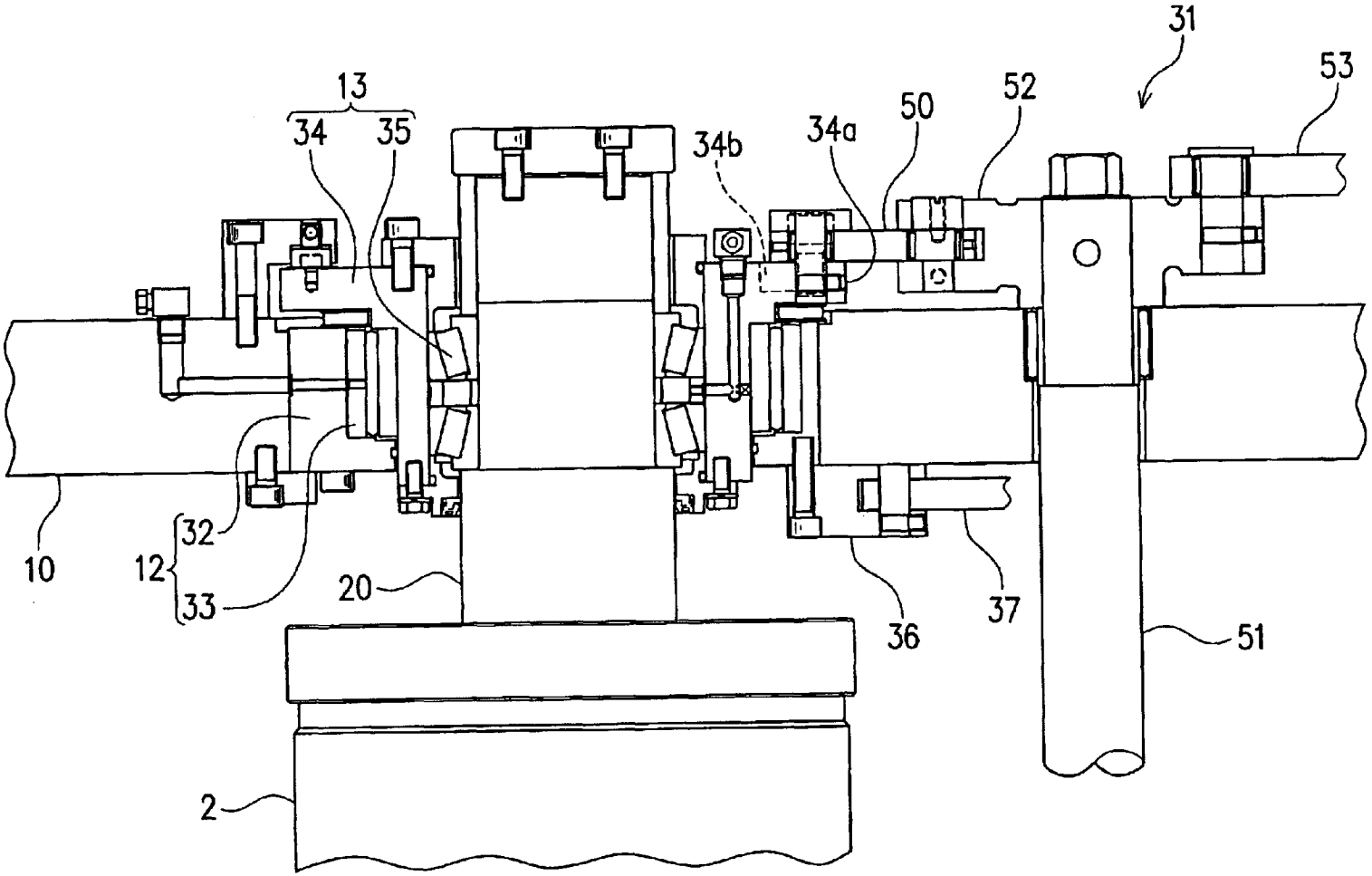
FIG. 3 is a cross section of essential portions of the support structure.

The frame 11, which is opposite to the frame 10 of FIG. 3, has the same arrangement, in which the shaft 20 of the blanket cylinder 2 is supported by a pair of the oppositely positioned frames 10, 11 respectively via the first and second eccentric bearings 12, 13.

Figure 4:
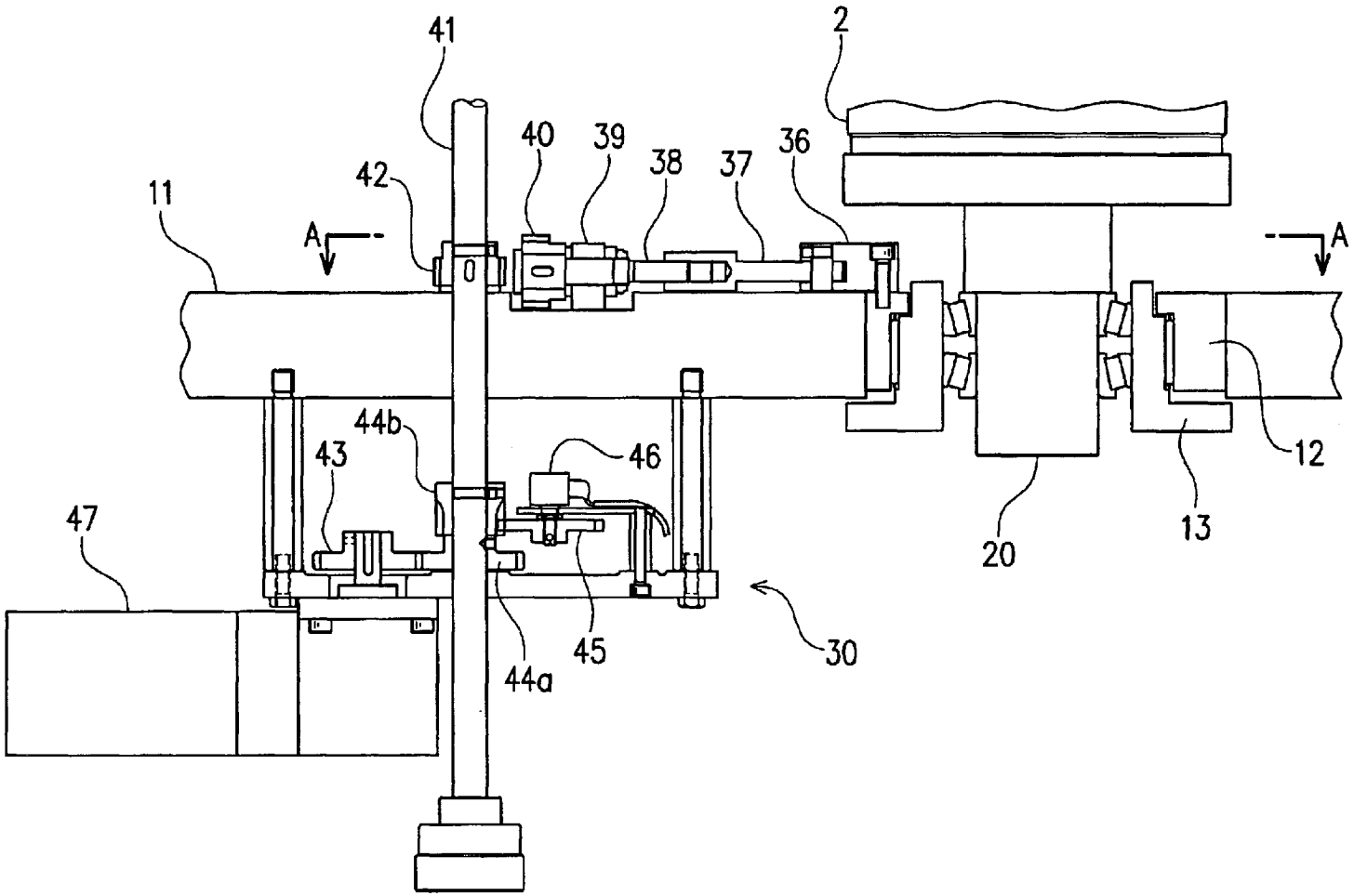
FIG. 4 is another cross section of the essential portions of the support structure.

The printing pressure adjustment device 30 has an arrangement as described below. FIG. 4 illustrates the frame 11 opposite to the frame 10 of FIG. 3, in which the first and second eccentric bearings 12, 13 are schematically illustrated.

Figure 5:
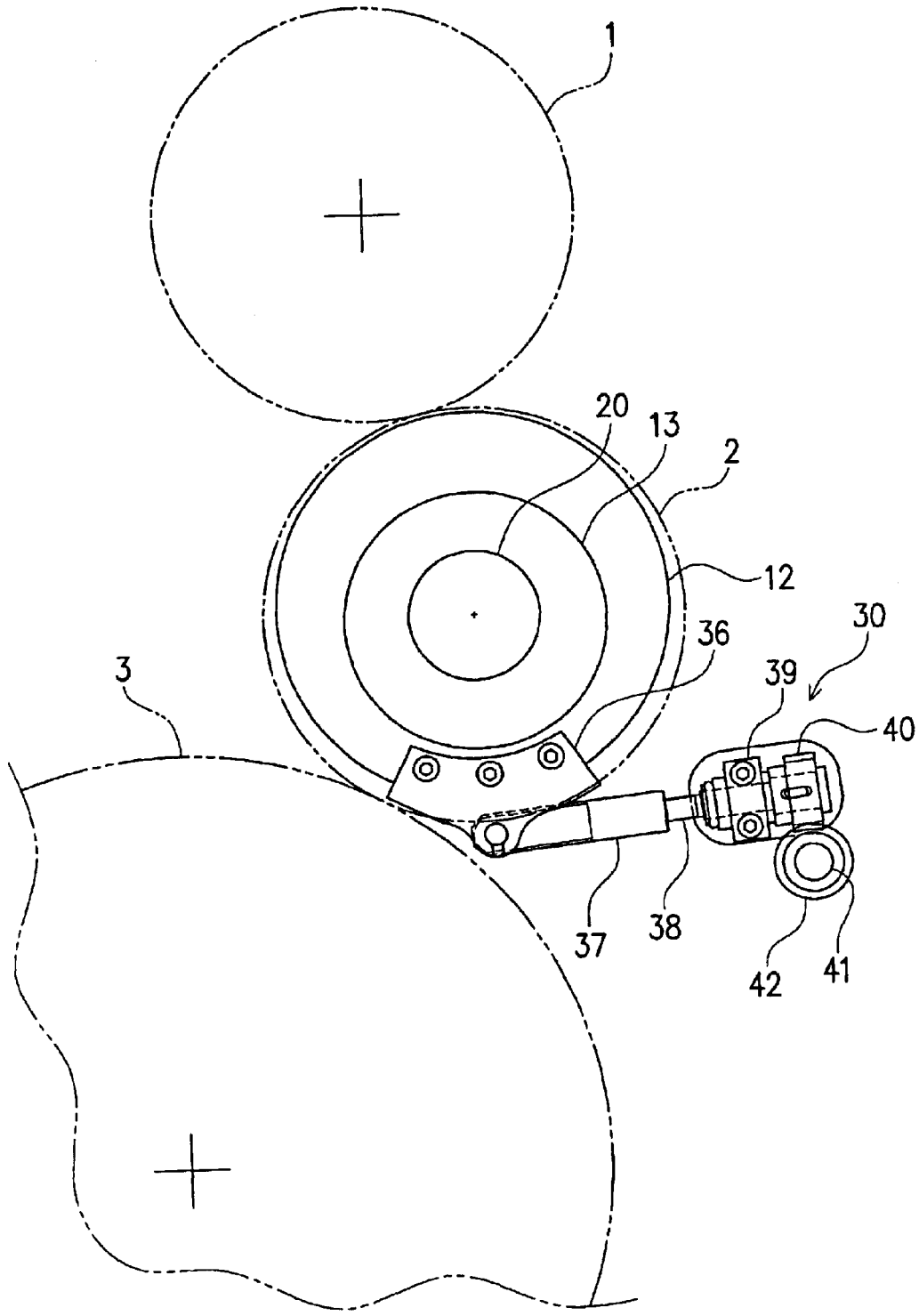
FIG. 5 is a view as viewed from line A—A in FIG. 4.

As illustrated in FIGS. 4 and 5, on the inner side of the frame 11, a connection plate 36 is secured to the outer metal bearing part 32 of the first eccentric bearing 12 by bolts. A connection rod 37 is attached at its first end to the connection plate 36 so as to be pivotally movable. A screw shaft 38 has a threaded part at its first end, which is screwed into the second end of the connection rod 37, while being rotatably supported by a bracket 39 secured in position on the inner side of the frame 11. The screw shaft also has a helical gear 40 attached to the second end thereof. These members are also arranged on the inner side of the frame 10 of FIG. 3 in the same manner as above. Accordingly, driving force is simultaneously transmitted to both helical gears 40 of the frames 10 and 11 via a single drive shaft 41 rotatably supported by the frames 10, 11 and disposed as bridging therebetween and a pair of oppositely positioned helical gears 42. The rotation of the drive shaft 41, which is effected by the transmission of the driving force from a motor 47 via gears 43, 44*a*, is detected by a potentiometer 46 as a rotational angle detector via gears 44*b*, 45. For ease of understanding, in FIG. 4, the helical gear 42 and the helical gar 40 are illustrated as being separated from each other.

The throw-on device 31 has an arrangement as described below. As illustrated from FIG. 3 and FIGS. 6–8, a radially outwardly extending annular collar 34*a* is formed on an end surface of the inner metal bearing part 34 of the second eccentric bearing 13 and located outside of each of the frames 10, 11. A connection link 50 is pivotally movably attached at its first end to the end surface of the inner metal bearing part 34, while being pivotally movably attached at its second end to a pivotally moving member 52 that is secured to a support shaft 51 that is in turn rotatably supported by the frames 10, 11. A rod 53 of an air cylinder (not shown) has an end pivotally movably attached to the pivotally moving member 52 so as to be pivotally movable around the support shaft 51 by the forward and backward movement of the air cylinder, thereby rotating the second eccentric bearing 13 relative to the first eccentric bearing 12.

Figure 6:
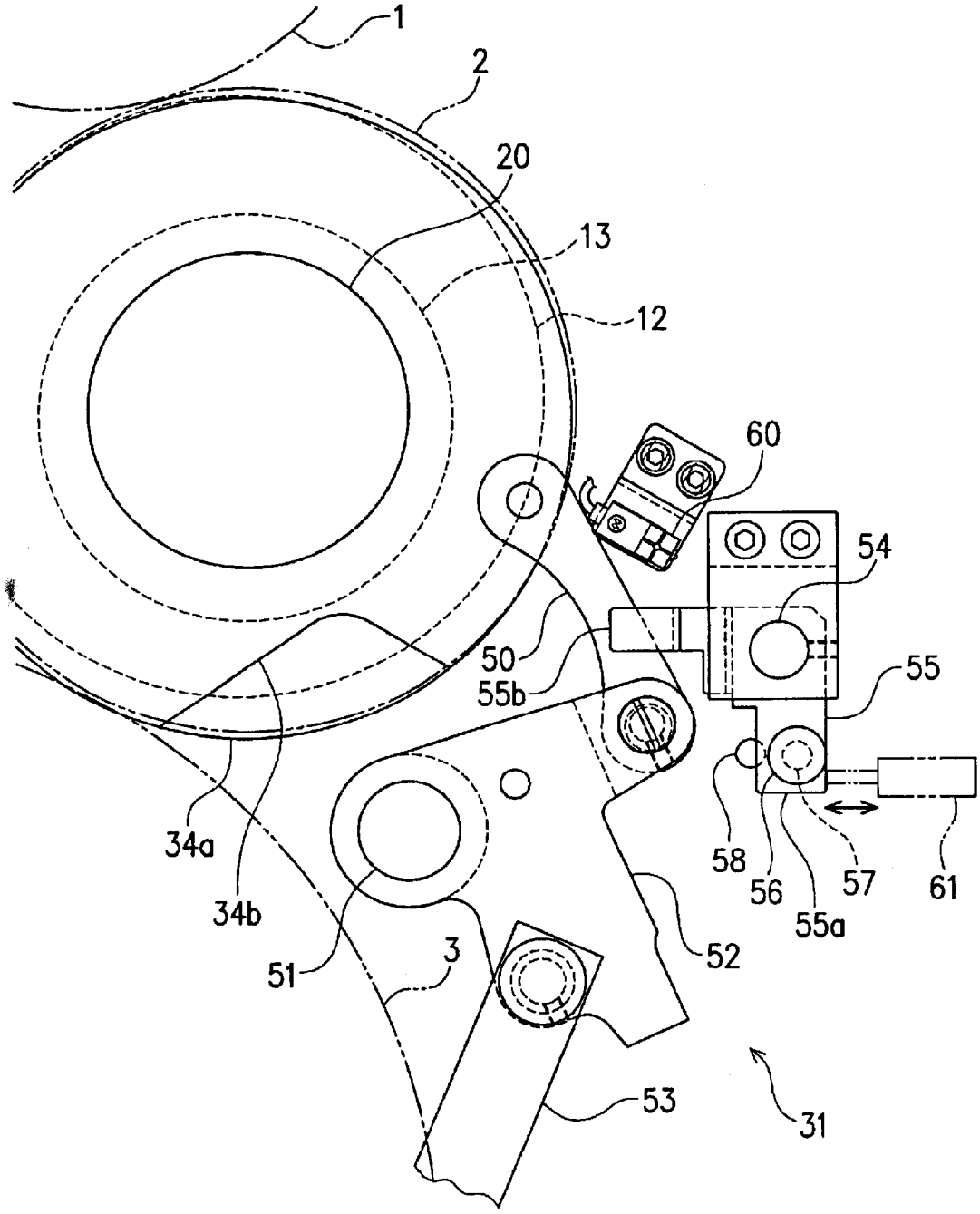
FIG. 6 is a front view illustrating a throw-out state when a throw-on device of the support structure is in a standard mode.
Figure 7:
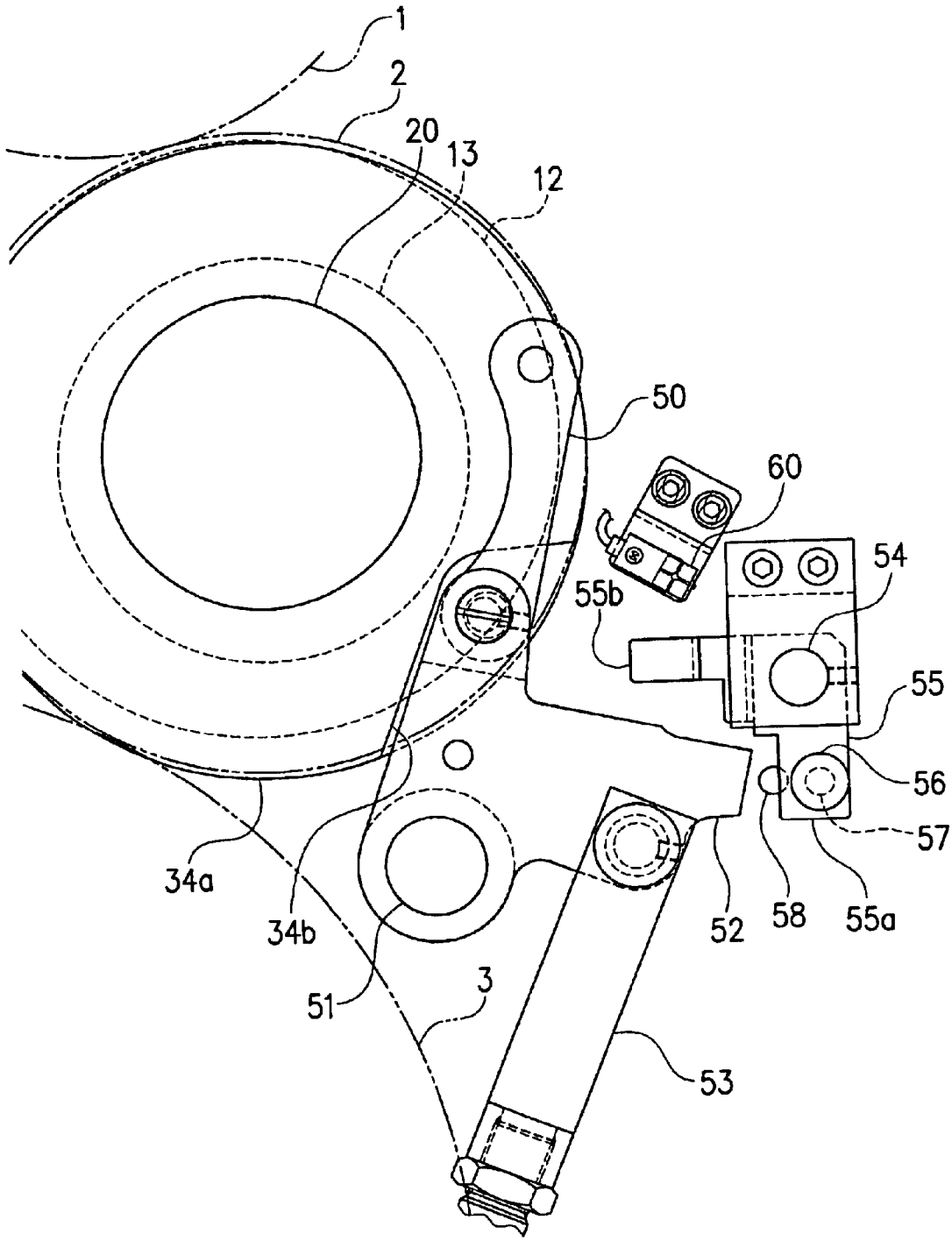
FIG. 7 is a front view illustrating a throw-on state when the throw-on device is in the standard mode.

FIG. 6 illustrates the throw-out state when the air cylinder is in IN-state with the rod positioned internally to the air cylinder. FIG. 7 illustrates the throw-in state when the air cylinder is in OUT-state with the rod positioned externally to the air cylinder. A cut-out 34*b* is formed on the annular collar 34*a* of the inner metal bearing part 34 in order to avoid interference between the pivotally moving member 52 and the second eccentric bearing 13 in the travel of the pivotally moving member 52 towards the second eccentric bearing 13 following the movement of the air cylinder into the OUT-state. Thus, the throw-on and throw-out operations are achieved by the pivotal movement of the pivotally moving member 52 with the air cylinder serving as a driving source.

The throw-on device 31 is capable of being selectively switched between two modes, namely a standard mode for a standard throw-on distance (i.e., the distance along which the blanket cylinder travels being standard) and a thick-sheet mode for a small throw-on distance (i.e., the distance along which the blanket cylinder travels being smaller than the standard throw-on distance by a predetermined amount).

Figure 8:
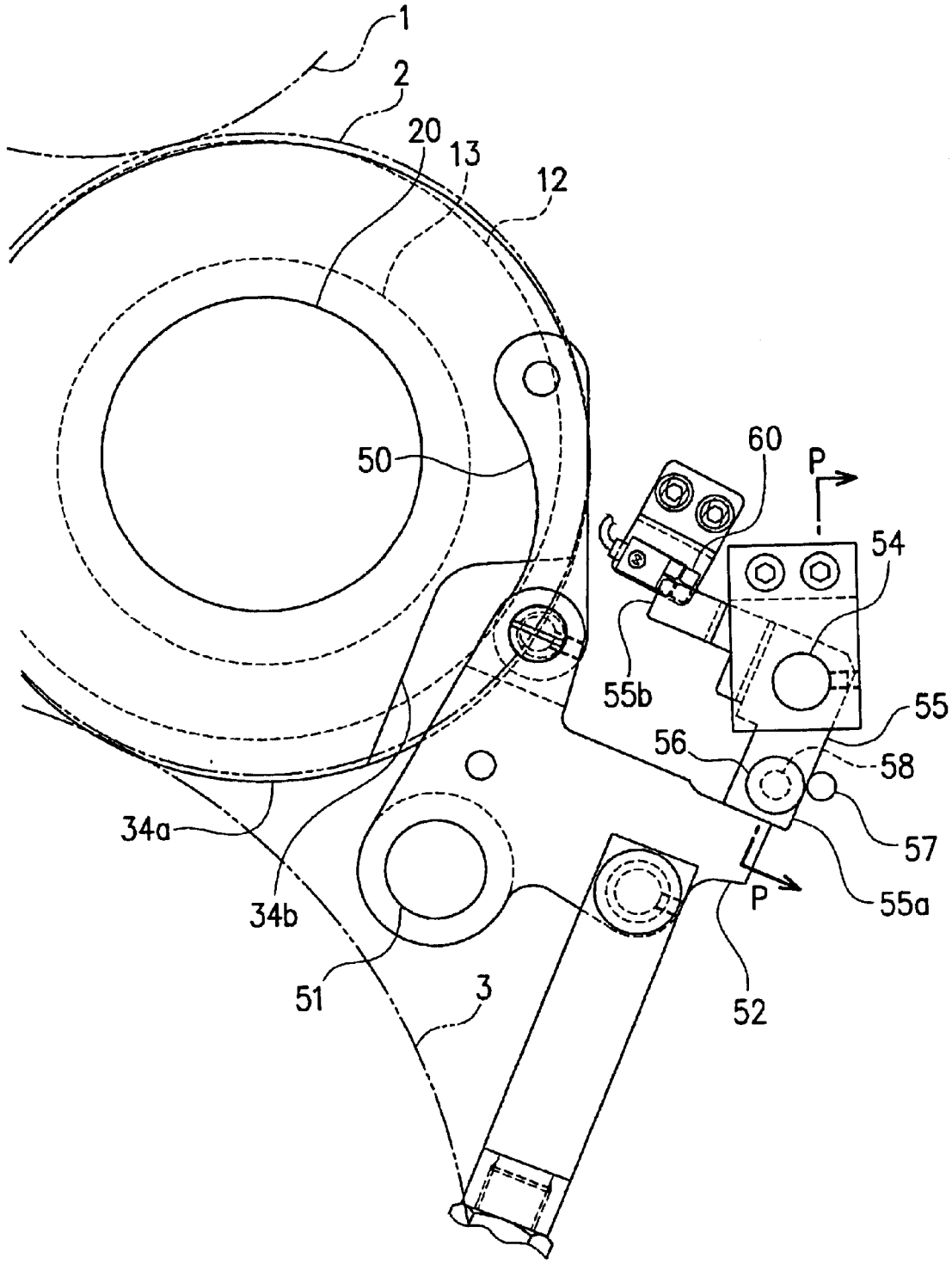
FIG. 8 is a front view illustrating a throw-on state when the throw-on device is in a thick-sheet mode.

FIGS. 6 and 7 illustrate the standard mode, while FIG. 8 illustrates the throw-on state in the thick-sheet mode. As being apparent from FIGS. 6–9, stopper members 55 are rotatably supported by pins 54 secured on the frames 10, 11. It is preferable to provide both frames 10, 11 with the stopper members 55 in light of durability or the like, but is still possible to provide either one of them with a single stopper member.

Figure 9:
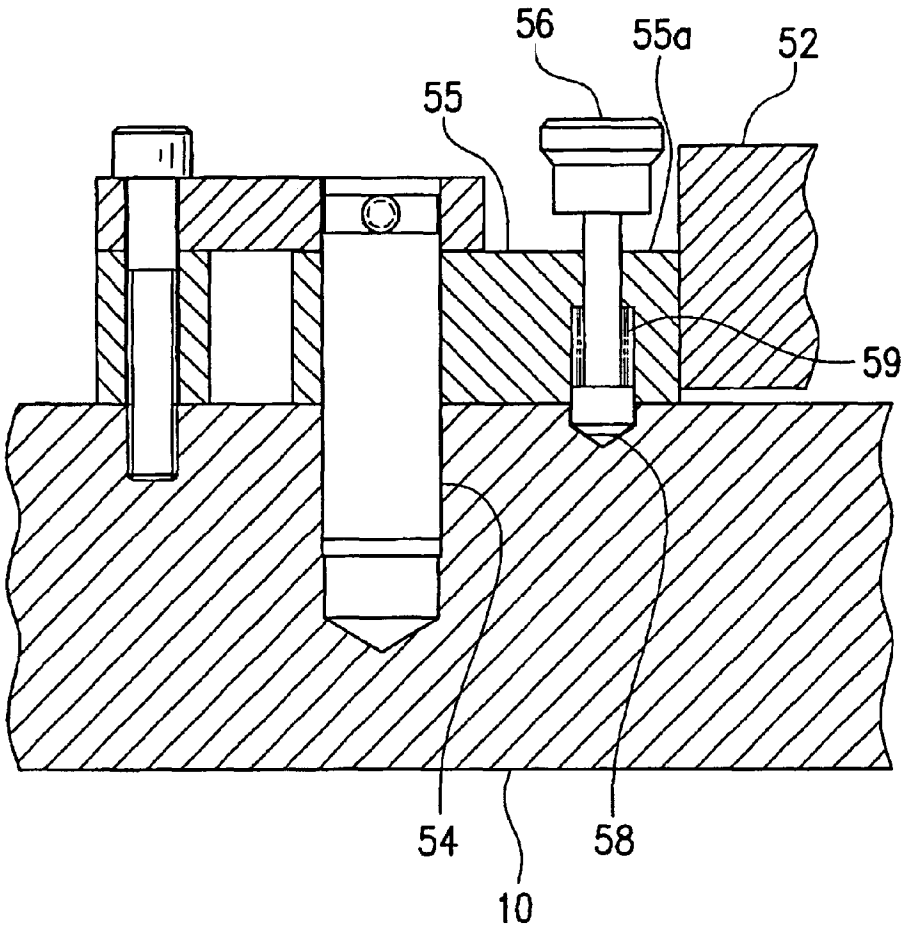
FIG. 9 is a cross section taken along line P—P in FIG. 8.

The stopper members 55 each have a substantially L-shape with a first arm 55*a*, through which a fixing pin 56 passes. The fixing pin 56 is capable of being selectively inserted into holes 57, 58 of each of the frames 10, 11 to stop the rotation of the stopper member 55. The fixing pin 56 is urged towards the frame 10 by a spring 59 mounted in the stopper member 55, as illustrated in FIG. 9. The urging force of the spring 59 allows the fixing pin 56 to be continuously held in the hole 57, 58 of the frame 10. The frame 10 has these two holes 57, 58 arranged so that once the fixing pin 56 is inserted into the hole 57, the stopper member 55 is brought into a withdrawn position (standard position), which enables the pivotally moving member 52 not to abut against the stopper member 55 in the throw-on operation and hence the air cylinder to be held entirely in the OUT-state. This state represents the throw-on state in the standard mode, producing a throw-on distance (standard throw-on distance) corresponding to the stroke of the air cylinder.

On the other hand, when the operational mode is to be switched from the standard mode to the thick-sheet mode, the fixing pin 56 is pulled out of the hole 57, and then stopper member 55 is rotated about the support shaft 51 and then the fixing pin 56 is inserted into the hole 58. Whereby, the stopper member 55 is shifted from the withdrawn position to a regulatory position. By bringing the air cylinder into the OUT-state from the throw-out state in the same manner as the standard mode with the stopper member 55 held at the regulatory position, the pivotally moving member 52 is rotated, abutted against the stopper member 55 and then stopped in the course of rotation. That is, the air cylinder is stopped halfway so that the rotational angle of the pivotally moving member 52 is smaller than in the standard mode. Accordingly, the rotational angle of the second eccentric bearing 13 is smaller than in the standard mode, and the throw-on distance is smaller than in the standard mode. That is, while the thick-sheet mode is the same as the standard mode in the throw-out position of the blanket cylinder 2, the throw-on distance from this throw-out position is different therebetween. Herein, a standard throw-on distance (i.e., the throw-on distance in the standard mode) is therefore smaller than a thick-sheet throw-on distance (i.e., the throw-on distance for thick sheets in the thick-sheet mode). This means that although the throw-out positions in both modes are the same as each other, the throw-on position is different between these modes so that when in the thick-sheet mode, the blanket cylinder 2 is thrown on to a position far away from the impression cylinder 3 than in the standard mode.

Now, the description will be made for the actual use of the thus arranged support structure of the blanket cylinder 2.

Figure 10:
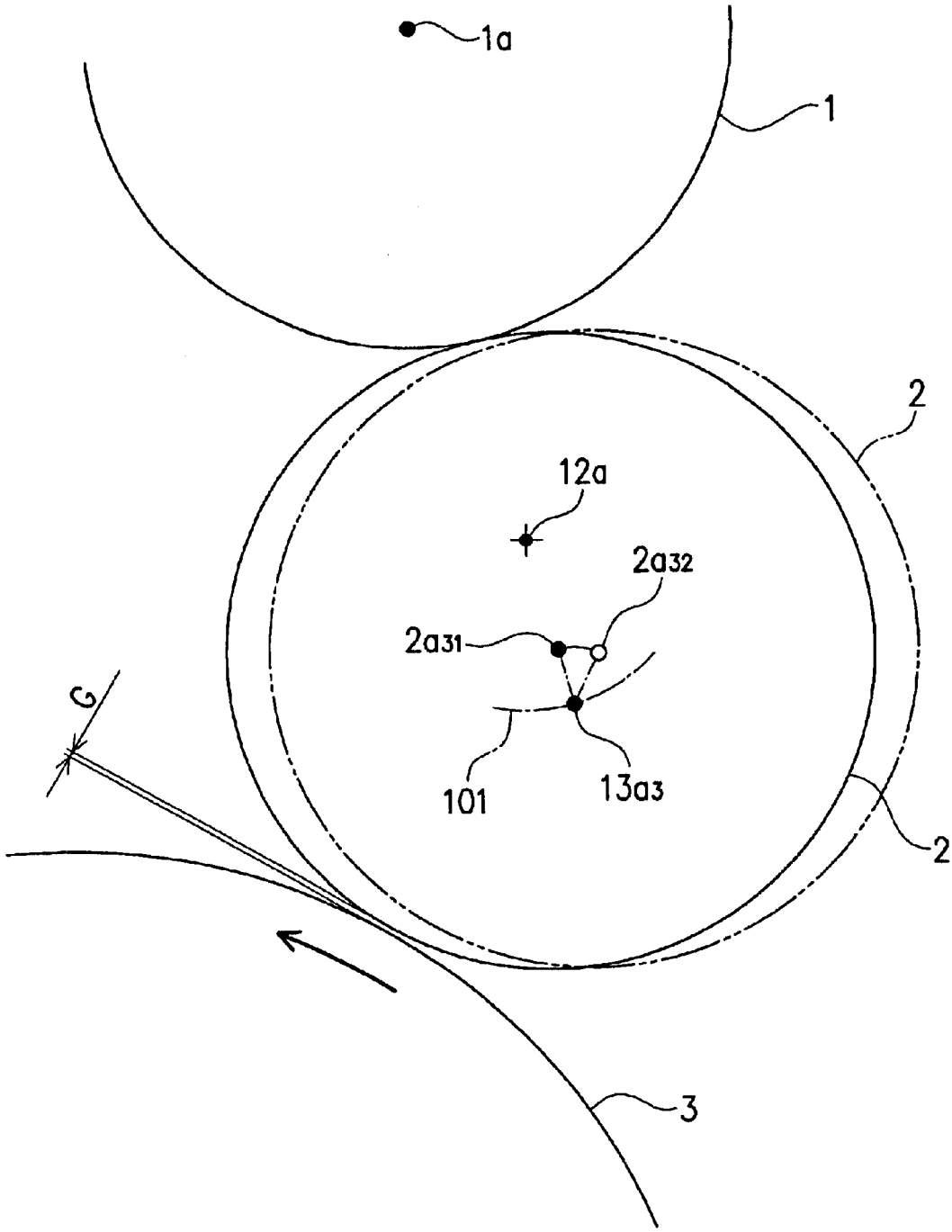
FIG. 10 is a schematic view for illustration of the throw-on and throw-out operations in the standard mode for thin sheets.
Figure 11:
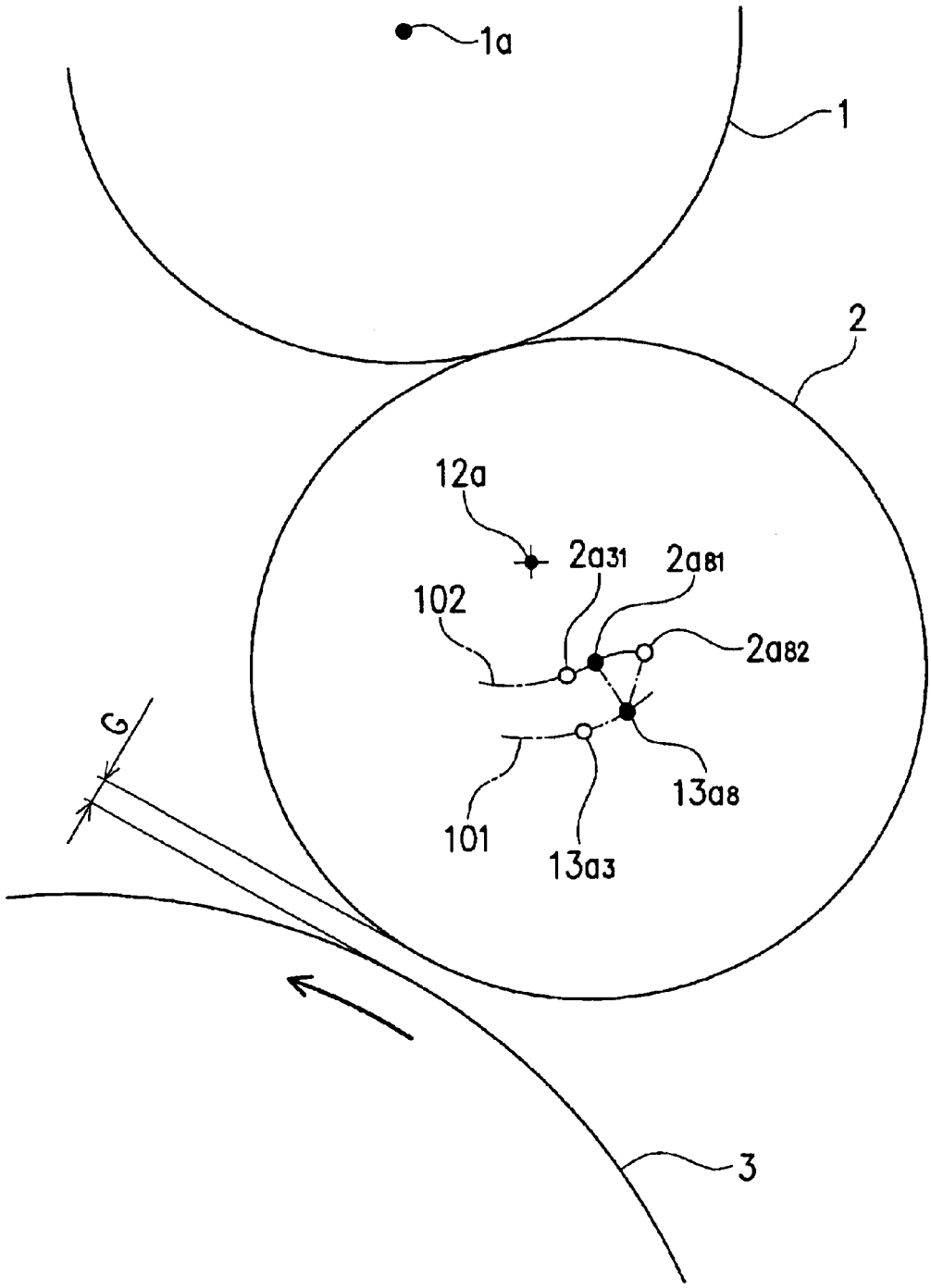
FIG. 11 is a schematic view for illustration of the throw-on and throw-out operations in the standard mode for thick sheets.

The operator sets the throw-on device 31 in the standard mode by withdrawing the stopper member 55 by inserting the fixing pin 56 into the hole 57, when thin sheets are used. Because the throw-on device 31 is in the standard mode, the blanket cylinder 2 is moved by the printing pressure adjustment device 30 so as to have the clearance G between the blanket cylinder 2 and the impression cylinder 3 slightly smaller than the sheet thickness by a predetermined amount. For example, where the sheet thickness is 0.3 mm, the clearance G between the blanket cylinder 2 and the impression cylinder 3 is adjusted by the printing pressure adjustment device 30 so as to be suitable for sheets having a thickness of 0.3 mm. That is, taking into account possible deformation of the blanket cylinder 2 in the printing operation, the clearance G is set at about 0.2 mm (i.e., about 0.1 mm smaller than the sheet thickness) in a state before the printing operation. In FIG. 10, the blanket cylinder 2 at the throw-on position and the throw-out position is illustrated respectively in solid line and chain double-dashed line. The axis 2*a* of the blanket cylinder 2 is shifted around the axis $\mathbf{13}a_3$ of the second eccentric bearing 13, following an arc trajectory, so as to secure the standard throw-on distance by the throw-on and throw-out operations. Herein, the axis of the blanket cylinder 2 in the throw-on position and the throw-out position is represented respectively by reference codes $\mathbf{2}a_{31}$ and $\mathbf{2}a_{32}$.

On the other hand, when thick sheets are used, the operator can easily switch the throw-on device 31 into the thick-sheet mode only by removing the fixing pin 56 from the hole 57 and inserting the same into the hole 58. By switching the throw-on device 31 into the thick-sheet mode, the throw-on distance in the throw-on device 31 becomes smaller than the standard throw-on distance so as to be suitable for thick sheets. Therefore, the printing pressure is adjusted in consideration of the throw-on distance for thick sheets. More specifically, when the sheet thickness is changed such as from 0.3 mm to 0.8 mm, the clearance G between the blanket cylinder 2 and the impression cylinder 3 is changed from a clearance for a sheet thickness of 0.3 mm to a clearance for a sheet thickness of 0.8 mm. That is, it is necessary to change the clearance G from about 0.2 mm to about 0.7 mm. For this, in the standard mode, the clearance G is adjusted only by the printing pressure adjustment device 30. Specifically, in order to increase the clearance G between the blanket cylinder 2 and the impression cylinder 3 by about 0.5 mm, the first eccentric bearing 12 is rotated by a rotational angle corresponding to an increased amount of about 0.5 mm by rotating the motor 47 with an output from the potentiometer 46. The rotation of this first eccentric bearing 12 causes the axis of the second eccentric bearing 13 to be shifted from $\mathbf{13}a_3$ to $\mathbf{13}a_8$ and the axis of the blanket cylinder 2 to be shifted from $\mathbf{2}a_{31}$ to $\mathbf{2}a_{81}$, around the axis 12*a* of the first eccentric bearing 12*a* (i.e., the axis of the through-hole of the frame).

When the throw-out operation is made in the throw-on device 31 of the standard mode, the axis of the blanket cylinder 2 is shifted from $\mathbf{2}a_{81}$ to $\mathbf{2}a_{82}$ around the axis $\mathbf{13}a_8$ of the second eccentric bearing 13. On the contrary, when the throw-on operation is made, the axis of the blanket cylinder 2 is shifted from $\mathbf{2}a_{82}$ to $\mathbf{2}a_{81}$ around the axis $\mathbf{13}a_8$ of the second eccentric bearing 13. However, in this case, since the blanket cylinder 2 at the throw-on position is moved excessively close to the plate cylinder 1, the distance between the axes of the plate cylinder 1 and the blanket cylinder 2 becomes excessively small as exceeding an acceptable value so that the respective bearings of the plate cylinder 1, the blanket cylinder 2 and the like are subjected to excessive load and hence the possibility of occurrence of printing troubles is increased. It is to be noted that a sheet thickness of 0.8 mm is presented as a mere example and therefore it is a matter of course that the sheet thickness causing printing troubles is different for each printing press.

On the contrary to the above, when the operation has been switched to the thick-sheet mode, printing troubles are unlikely to occur. While the difference between throw-on distance for thick sheets and the standard throw-on distance can be varied in each operation, the description will be made by taking for example the case where the difference is set at 0.3 mm.

Figure 12:
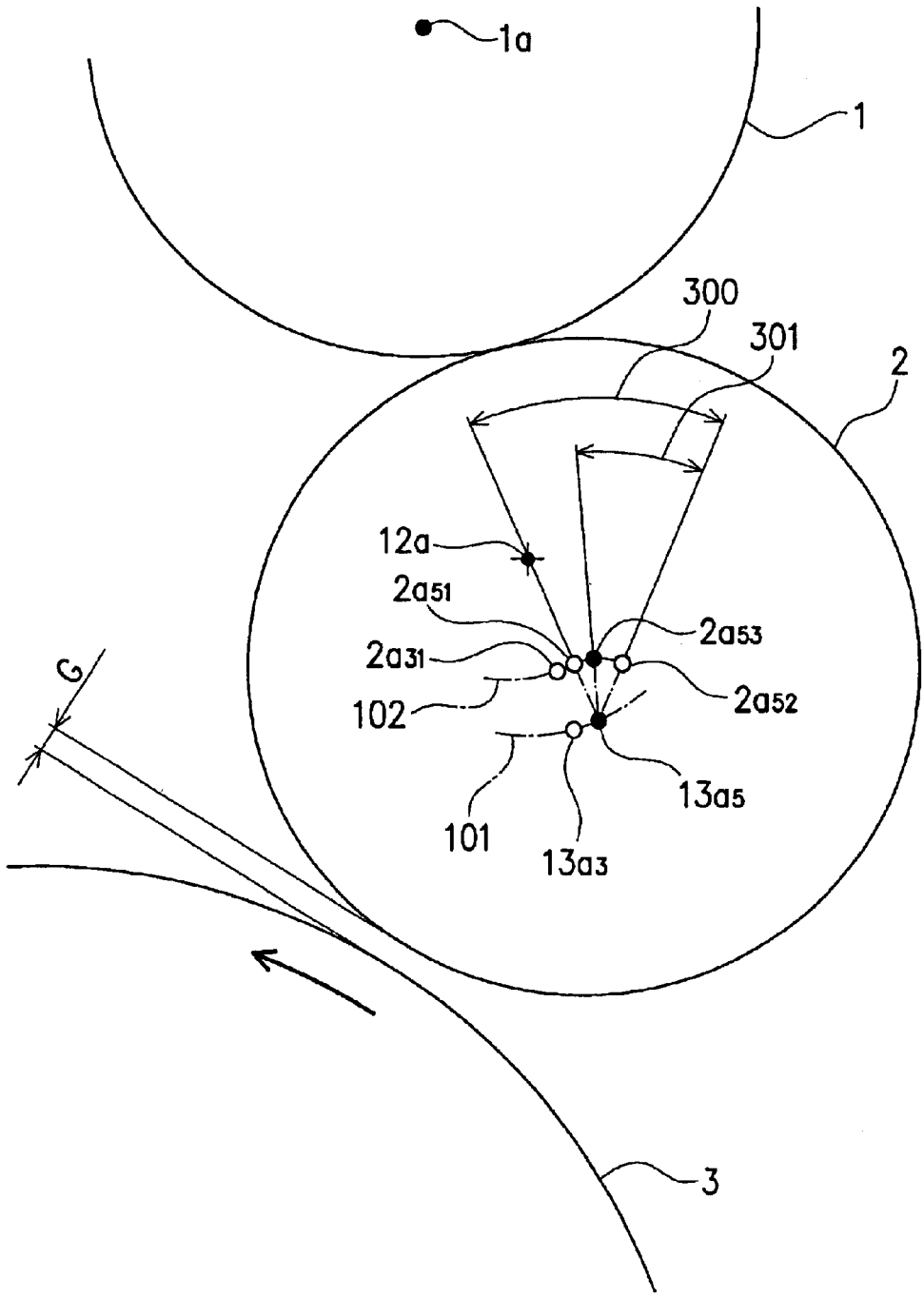
FIG. 12 is a schematic view for illustration of the throw-on and throw-out operations in the thick-sheet mode for thick sheets

In this case, as illustrated in FIG. 12, the first eccentric bearing 12 is rotated by the printing pressure adjustment device 30 so as to make the clearance G between the blanket cylinder 2 and the impression cylinder 3 match to a sheet thickness of 0.5 mm (i.e., a clearance of about 0.4 mm). This is equivalent to change in sheet thickness from 0.3 mm to 0.5 mm in the standard mode. This causes the axis of the second eccentric bearing 13 to be shifted from $\mathbf{13}a_3$ to $\mathbf{13}a_5$ and the axis of the blanket cylinder 2 to be shifted from $\mathbf{2}a_{31}$ to $\mathbf{2}a_{51}$, around the axis $\mathbf{12}a$ of the first eccentric bearing 12. Then, the throw-out operation is made in the throw-on device 31 with the air cylinder held in the IN state, thereby shifting the axis of the blanket cylinder 2 from $\mathbf{2}a_{51}$ to $\mathbf{2}a_{52}$ around the axis $\mathbf{13}a_5$ of the second eccentric bearing 13. It is to be noted that in the throw-on operation, the throw-on distance is smaller than in the standard mode because of the abutment between the pivotally moving member 52 and the stopper member 55, as illustrated in FIG. 8. That is, in FIG. 12, the axis of the blanket cylinder 2 is shifted from $\mathbf{2}a_{52}$ to $\mathbf{2}a_{53}$ around the axis $\mathbf{13}a_5$ of the second eccentric bearing 13. If the throw-out operation is made in the throw-on device 31 of the standard mode, the axis of the blanket cylinder 2 is shifted from $\mathbf{2}a_{52}$ to $\mathbf{2}a_{51}$ around the axis $\mathbf{13}a_5$ of the second eccentric bearing 13, which causes the clearance G of only about 0.4 mm (a state for a sheet thickness of 0.5 mm). In FIG. 12, a reference code 300 represents the moving angle of the axis of the blanket cylinder 2 in the standard mode, and a reference code 301 represents the moving angle in the thick-sheet mode.

When the thick-sheet mode is selected, the throw-on distance is smaller than in the standard mode. As a result, the clearance G between the blanket cylinder 2 and the impression cylinder 3 at the throw-on position is about 0.7 mm (a state for a sheet thickness of 0.8 mm). The clearance G is thus set to about 0.7 mm (a state for a sheet thickness of 0.8 mm), although the adjusting amount of the printing pressure adjustment device 30 corresponds only to a sheet thickness of 0.5 mm. Accordingly, the blanket cylinder 2 moves towards the plate cylinder 1 by an amount equivalent only to an amount in a case with a sheet thickness of 0.5 mm in the standard mode, and therefore the distance between the axes of the plate cylinder 1 and the blanket cylinder 2 falls within the acceptable value. Thus, it is possible to prevent printing troubles.

As described above, the operator is capable of using the standard mode for thin sheets and the thick-sheet mode for thick sheets. In addition, the mode switching operation can be made only by switching the hole, into which the fixing pin 56 is inserted, from one to another. This switching operation can be made by a reduced work load in a secure manner.

The above description was made by taking for example the arrangement enabling switching the throw-on distance between the two alternatives, namely the standard throw-on distance and the thick-sheet distance. In this regard, the throw-on distance can be switched between three or more alternatives, or in a non-stepwise manner. However, considering simplicity in switching structure and reduced possibility of errors in switching operation by the operator, the switching between the two alternatives is preferable.

Figure 13:
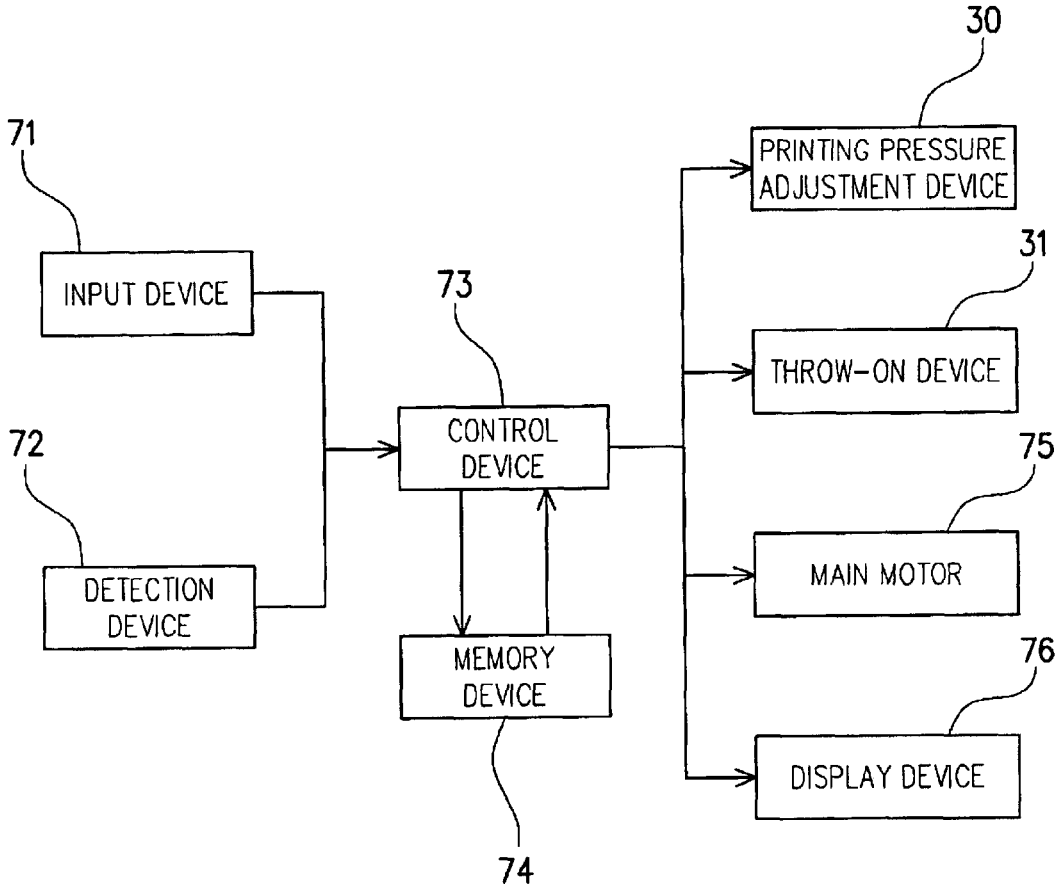
FIG. 13 is a block diagram of the support structure according to the one embodiment of the present invention.

For example, in a case where the switching is made between the two alternatives, a sensor 60 (a detection device) may be provided to detect the location of the stopper member 55, as illustrated in FIG. 8. FIG. 13 is a block diagram illustrating an arrangement with a detection device 72. A control device 73 controls the printing pressure adjustment device 30, the throw-on device 31, a display device 76 and a main motor 75 as a driving source for the printing action of the printing press of FIG. 1, on the basis of the input from an input device 71 or a detection device 72.

Returning to FIG. 8, for example, the sensor 60 is disposed on the frame 10 in order to detect the location of a second arm 55*b* of the substantially L-shaped stopper member 55. The sensor 60 may be provided only on the frame 10. The sensor 60 is designed to output a signal when the stopper member 55 is located at the regulatory position and output no signal when it is located at the withdrawn position. As the sensor 60, for example, a proximity sensor is used. Thus, the sensor 60 can detect whether the stopper member 55 is located at the regulatory position or withdrawn position, or the throw-on device 31 is in the standard mode or the thick-sheet mode. In other words, the sensor 60 serves as the detection device 72 for detecting whether the throw-on distance of the throw-on device 31 is the standard throw-on distance or the throw-on distance for thick sheets.

The control device 73 enables the display device 76 to display the current mode of the throw-on device 31 on the basis of the output of the sensor 60. Accordingly, the operator can securely observe the mode of the throw-on device 31 and hence operate the printing pressure adjustment device 30 according to the mode of the throw-on device 31.

As illustrated in FIG. 1, in the printing press equipped with several blanket cylinders 2, the control device 73 may be arranged so that when the throw-on amounts of these blanket cylinders 2 are not the same as each other, it makes the printing press incapable of printing. That is, the control device 73 determines whether the throw-on distances of the respective throw-on devices 31 are the same as each other on the basis of the output of the sensor 60. Where the control device 73 has determined all the throw-on distances are not the same as each other, it stops the main motor 75. The thus designed control device 73 can prevent occurrence of broke (paper loss) since the main motor 75 is not actuated even if the operator has unintentionally skipped switching operation for either one of the plural throw-on devices 31.

The control device 73 may be designed to control the printing pressure adjustment device 30 and the throw-on device 31 on the basis of the sheet thickness. The sheet thickness is inputted through the input device 71. The control device 73 controls the printing pressure adjustment device 30 and the throw-on device 31 on the basis of the information input through the input device 71 and the detection device 72. That is, the mode switching of the throw-on device 31 is not manually made but made automatically. An example of the arrangement enabling the mode switching of the throw-on device 31 is illustrated in FIG. 6, in which the stopper member 55 is pivotally reciprocatingly moved by a predetermined angle by a driving means such as a solenoid 61. The control device 73 controls the solenoid 61 on the basis of the sheet thickness input through the input device 71 to bring the stopper member 55 into the withdrawn or regulatory position, thereby achieving the mode switching, and accordingly controls the printing pressure adjustment device 30.

A memory device 74 has a reference value set as a threshold value for the mode switching. This switching reference value is set such as at a sheet thickness of 0.6 mm.

Specifically, where the sheet thickness before changing (i.e., the current sheet thickness) is 0.3 mm and the sheet thickness after changing is 0.8 mm, 0.6 mm set as the switching reference value is on the way to a value of 0.8 mm. Accordingly, passing the reference value during the change causes the operational mode to be shifted from the standard mode to the thick-sheet mode. When the sheet thickness is changed from 0.8 mm to 0.3 mm, the operational mode is reversely changed, namely from the thick-sheet mode to the standard mode. When the sheet thickness is changed without passing the reference value for switching, such as from 0.1 mm to 0.4 mm or 0.6 mm to 0.8 mm, the operational mode of the throw-on device 31 is held in the current mode. That is, when in the former case, the standard mode is sustained and when in the latter case, the thick-sheet mode is sustained.

For example, given the change of the sheet thickness from 0.1 mm to 0.5 mm, this change is made within a range less than the switching reference value. Accordingly, the throw-on device 31 is held in the standard mode with designating a change amount of 0.4 mm in sheet thickness as the adjusting amount of the printing pressure adjustment device 30. That is, the control device 73 rotates the motor 47 by an amount corresponding to an amount of 0.4 mm so as to move the blanket cylinder 2 to have the clearance G of about 0.4 mm (a state for a sheet thickness of 0.5 mm). This change amount is calculated by the control device 73 on the basis of a sheet thickness of 0.5 mm input through the input device 71 and a current sheet thickness of 0.1 mm stored in the memory device 74. The control device 73 transmits a newly inputted sheet thickness of 0.5 mm to the memory device 74, in which the transmitted sheet thickness is stored.

Likewise, given the change of the sheet thickness from 0.7 mm to 0.8 mm, this change is made within a range equal to or more than the switching reference value. Accordingly, the throw-on device 31 is held in the thick-sheet mode with designating a change amount of 0.1 mm as the adjusting amount of the printing pressure adjustment device 30.

Contrarily to the above, for example, where the sheet thickness is changed from 0.1 mm to 0.8 mm, this change involves passing the switching reference value of 0.6 mm and therefore causes the throw-on device 31 to be switched from the standard mode to the thick-sheet mode. This mode switching is detected by the sensor 60, and the detected result is transmitted to the control device 73. Then, the control device 73 calculates 0.4 mm by subtracting a difference of 0.3 mm between the standard throw-on distance and the thick-sheet throw-on distance from a change amount of 0.7 mm in sheet thickness, and designates "0.4 mm" as the adjusting amount of the printing pressure adjustment device 30. That is, the control device 73 rotates the motor 47 of the printing pressure adjustment device 30 by an amount corresponding to an amount of 0.4 mm so as to move the blanket cylinder 2 to have the clearance G of about 0.7 mm (a state for a sheet thickness of 0.8 mm). The adjustment to decrease the sheet thickness is made in the same manner.

Thus, the further automatization, that is, the above automatic mode switching operation of the throw-on device 31 can achieve a proper mode switching operation based on the proper mode selection according to the sheet thickness, as well as enabling the printing pressure adjustment device 30 to have an adjusting amount controlled according to the sheet thickness. As a result, it is possible for the operator to achieve the mode switching operation only by inputting the sheet thickness into the input device 71, thus remarkably reducing the work load of the operator.

It is possible to employ a touch panel display for the display device 76 so as to enable the display device 76 to serve also as the input device 71.

Where the printing pressure adjustment device 30 is not equipped with the motor 47 and therefore the drive shaft 41 is manually rotated, it is preferable to enable the display device 76 to display both the mode of the throw-on device 31 on the basis of the output of the sensor 60 and the rotational rate of the drive shaft 41 corresponding to that mode. Whereby, the operator can manually operate the drive shaft 41 with reference to the rotational rate displayed on the display device 76.

As described above, the variable throw-on distance as employed enables itself to be small for thick sheets and hence the printing pressure adjustment device 30 to decrease its adjusting amount. Accordingly, the change in distance between the axes of the plate cylinder 1 and the blanket cylinder 2 due to the change in sheet thickness can be limited. As a result, even in the absence of an adjusting mechanism for adjusting the axis of the plate cylinder, it is possible to have the distance between the plate cylinder and the blanket cylinder 2 falling within an acceptable range, and hence prevent printing troubles.

This specification is by no means intended to restrict the present invention to the preferred embodiments set forth therein. Various modifications to the support structure of a blanket cylinder of an offset printing press, as described herein, may be made by those skilled in the art without departing from the spirit and scope of the present invention as defined in the appended claims.

What is claimed is:

1. A support structure for a blanket cylinder of an offset printing press comprising:

a first eccentric bearing that is rotatably supported by frames of the offset printing press;

a second eccentric bearing that is rotatably supported by said first eccentric bearing so as to rotatably support an shaft of a blanket cylinder;

a printing pressure adjustment device that rotates said first eccentric bearing relative to said frames, thereby adjusting a clearance between an impression cylinder and a blanket cylinder; and a throw-on device that rotates the second eccentric bearing relative to said first eccentric bearing, thereby performing throw-on and throw-out operations, wherein a throw-on distance of said throw-on device is variable.

2. The support structure according to claim 1, wherein said throw-on distance of said throw-on device is switchable between a standard throw-on distance and a thick-sheet throw-on distance, said thick-sheet throw-on distance being smaller than said standard throw-on distance.

3. The support structure according to claim 2 further comprising a control device that controls said printing pressure adjustment device and said throw-on device on the basis of the thickness of sheets to be printed, wherein:

said control device switches the throw-on distance of said throw-on device from said standard throw-on distance to said thick-sheet throw-on distance and designates the result determined by subtracting the difference between said standard throw-on distance and said thick-sheet throw-on distance from the change amount of the thickness of sheets as the adjusting amount of said printing pressure adjustment device where the thickness of sheets before changing is less than a predetermined value and the thickness of sheets after changing is equal to or more than said predetermined value;

said control device switches said throw-on distance of said throw-on device from said thick-sheet throw-on distance to said standard throw-on distance and designates the result determined by subtracting the difference between said standard throw-on distance and said thick-sheet throw-on distance from the change amount of the thickness of sheets as the adjusting amount where the thickness of sheets before changing is equal to or more than said predetermined value and the thickness of sheets after changing is less than said predetermined value; and said control device does not switch said throw-on distance of said throw-on device and designates the change amount of the thickness of sheets as the adjusting amount of said printing pressure adjustment device where both the thicknesses of sheets before and after changing are either less than, or equal to or more than said predetermined value.

4. The support structure according to claim 1, wherein said support structure is designed for supporting plural blanket cylinders of a multi-color printing press, wherein said printing pressure adjustment device and said throw-on device are provided for each of said plural blanket cylinders, and said control unit makes said printing press incapable of printing where the throw-on distances of all the throw-on devices are not the same as each other.

5. The support structure according to claim 2, wherein said support structure is designed for supporting plural blanket cylinders of a multi-color printing press, wherein said printing pressure adjustment device and said throw-on device are provided for each of said plural blanket cylinders, and said control unit makes said printing press incapable of printing where the throw-on distances of all the throw-on devices are not the same as each other.

* * * * *